US005184732A

United States Patent [19]

Ditchburn, deceased, et al.

[11] Patent Number: 5,184,732

[45] Date of Patent: Feb. 9, 1993

[54] SHAPE SORTING

[75] Inventors: Robert W. Ditchburn, deceased, late of Oxfordshire, by Doreen May Ditchburn, executrix; Martin P. Gouch, Hertfordshire; Nigel R. Cook, Maidenhead; Timothy J. Osgood, Basingstoke; Stephen P. Holloway, Berkshire; Ian W. Bowler, Durham, all of Great Britain

[73] Assignee: Gersan Establishment, Vaduz, Liechtenstein

[21] Appl. No.: 552,993

[22] Filed: Jul. 16, 1990

Related U.S. Application Data

[63] Continuation-in-part of Ser. No. 214,465, Jul. 1, 1988, Pat. No. 4,946,045, which is a continuation of Ser. No. 943,128, Dec. 18, 1986, abandoned.

[30] Foreign Application Priority Data

Dec. 20, 1985 [GB] United Kingdom ..... 8531396
Jun. 25, 1990 [GB] United Kingdom ..... 9014122

[51] Int. Cl.[5] ..... B07C 5/342

[52] U.S. Cl. ..... 209/576; 209/586; 209/598; 356/376; 358/106; 364/560; 382/25

[58] Field of Search ..... 209/576, 577, 587, 586, 209/939, 598; 382/10, 36, 25; 356/379, 380, 376; 364/560, 564; 358/106

[56] References Cited

U.S. PATENT DOCUMENTS 3,035,480 5/1962 Teucher .
3,549,008 12/1970 Anderson .
3,858,979 1/1975 Elbe .
3,867,032 2/1975 Bruck .
4,205,973 6/1980 Ryan .
4,324,335 4/1982 Conway et al. .
4,493,420 1/1985 Dennis .
4,624,367 11/1986 Shafer et al. .
4,666,045 5/1987 Gillespie et al. .
4,735,323 4/1988 Okada et al. ..... 209/586 X
4,818,380 4/1989 Azegami et al. ..... 209/586 X
4,896,279 1/1990 Yoshida ..... 382/25 X
4,946,045 8/1990 Ditchburn et al. ..... 209/576
5,023,917 6/1991 Bose et al. ..... 358/106

FOREIGN PATENT DOCUMENTS

105452A2 4/1984 European Pat. Off. .
0374604 6/1990 European Pat. Off. .

(List continued on next page.)

OTHER PUBLICATIONS

Young, Tzay Y. and Fu, King-Sun, *Handbook of Pattern Recognition and Image Processing*, 1986, pp. 12–17 and 22–29, pp. 60–61.

"Measurement of Parameters of Polyhedra on a Turntable by a TV Camera", Hideo Kikuchi and Saiburo Tsuji, *Systems Computers Controls*, vol. 8, No. 3, May 1977, pp. 18–26.

"Beitrag zum Brillanzproblem", Siegfried Rosch, *Zeit. Kristallogr*, 1927, pp. 46–68.

"Precision Machinery for the Diamond Industry", *The Piermatic Mark III*, pp. 30–32.

*Primary Examiner*—Donald T. Hajec
*Attorney, Agent, or Firm*—Kerkam, Stowell, Kondracki & Clarke

[57] ABSTRACT

In order to provide an accurate sort into many different classes, objects are dropped through a viewing zone and viewed in the same instant by a number of viewers. Each viewer provides electronic signals representative of three basic shape features, namely blockiness, symmetry and convex hull deviance, together with a total count of edge-breakthroughs. For each basic shape feature, the maximum, minimum and mean are obtained for all the viewers, except the minimum convex hull deviance signal. These signals, together with the edge-breakthrough count, are each subjected to a linear transformation to provide a normalized shape parameter which is then assigned a value of 0 to 15 for each class being sorted on the basis of the expected occurrence of that parameter in that class. Each pair of secondary shape parameters so determined is used to derive from a respective table a decision value. The shape class of the object is ascertained on the basis of a majority vote for all the shape decision values.

18 Claims, 8 Drawing Sheets

FOREIGN PATENT DOCUMENTS

| | | |
|---|---|---|
| 2726-162 | 12/1977 | Fed. Rep. of Germany . |
| 53197 | 10/1977 | Israel . |
| 77684 | 10/1977 | Israel . |
| 87/01974 | 4/1987 | PCT Int'l Appl. . |
| 87/01975 | 4/1987 | PCT Int'l Appl. . |
| 715619 | 9/1954 | United Kingdom . |
| 853978 | 11/1960 | United Kingdom . |
| 1143541 | 2/1969 | United Kingdom . |
| 1167787 | 10/1969 | United Kingdom . |
| 1449565 | 3/1974 | United Kingdom . |
| 1416568 | 12/1975 | United Kingdom . |
| 1571889 | 3/1977 | United Kingdom . |
| 1571890 | 3/1977 | United Kingdom . |
| 2022824A | 12/1979 | United Kingdom . |
| 2030286A | 4/1980 | United Kingdom . |
| 2037980A | 7/1980 | United Kingdom . |
| 2067753A | 7/1981 | United Kingdom . |
| 2067924A | 8/1981 | United Kingdom . |
| 2080712A | 2/1982 | United Kingdom . |
| 2081439A | 2/1982 | United Kingdom . |
| 2142426A1 | 1/1985 | United Kingdom . |
| 2184832 | 7/1987 | United Kingdom . |

SHAPE SORTING

The present application is a continuation-in-part of U.S. Ser. No. 214,465, filed in the name of Ditchburn et al on Jul. 1, 1988, entitled "Sorting", the disclosure of which is incorporated herein by reference as fully as if set forth in its entirety. The Ser. No. 214,465 application, now U.S. Pat. No. 4,949,045, was in turn a continuation of U.S. Ser. No. 943,128, filed Dec. 18, 1986, now abandoned.

BACKGROUND OF THE INVENTION

This invention relates to a method of and apparatus for ascertaining the classification of the shape of an object based upon deriving a set of values for features representative of the shape of the object. In particular the invention relates to a method of and apparatus for ascertaining the classification of the shape of a succession of objects so that they can be sorted according to shape, including the steps of feeding each successive object through a viewing zone and illuminating the object as it passes through the viewing zone, viewing the object in the viewing zone, processing the image of the object in the viewing zone and thereafter directing the object into one of at least two paths according to its shape. The objects may be for instance edible products such as peas or sweets, but the invention is in no way limited to edible products.

THE INVENTION

The invention provides a method of ascertaining the shape class of an object, comprising:

deriving a set of primary shape parameters representative of the shape of the object, taking a group of two or more of the primary shape parameters to provide coordinates for deriving from a table a decision value for said group, the table being fixed for all the objects for said group;

repeating the process of deriving a decision value for all remaining possible different groups of two or more primary shape parameters, using a specific said table for each group; and ascertaining from the resulting set of decision values the shape class of the object.

Preferably the method is performed electronically in apparatus for sorting a succession of objects, in which each successive object is viewed as it passed through the viewing zone using one, two, three, four or more fixed viewers spaced in one plane around the viewing zone and normally at 90° to the direction of feed of the object, signals being derived from each viewer representative of the edges of the object as viewed at a particular instant by the viewers, the signals being used to provide the primary shape parameters for ascertaining the shape class of the object, the object being automatically directed into one of at least two paths according to the shape class of the object.

Using the invention, good sorting can be obtained. However, it is normally difficult to have a positive sort into acceptables and rejects and one solution is to provide at least three shape categories, namely acceptables, hand-sorts and rejects, the hand-sort category being necessary if the apparatus is unable to discriminate sufficiently; this is acceptable in practice if the percentage of hand-sorts is reasonably low.

The number of viewers can be reduced, and it is possible to use one viewer for sorting some objects, or two viewers, though a larger number is preferred, for instance three, four or more, the illumination is not restricted to visible light and may be for instance infrared. The machine may just classify, e.g. providing a total of the objects in each class, or may physically separate different classes of objects.

Although the method is preferably used in apparatus as set out above, any other machine capable of measuring primary shape parameters may be used.

Preferably the primary shape parameters used comprise the maximum, minimum and average values for all the viewers of the basic shape features of blockiness, symmetry and convex hull deviance as set out hereinafter and a satisfactory classification can be achieved on the basis of these three basic shape features, possible also with break-through (see below). However, other basic shape features that can be used are for instance:

central moments;

aspect ratio;

straightness of edge measure;

convex hull deviance normalized with respect to object size;

convex hull deviance normalised with respect to arc length of missing boundary;

area of convex hull to read area;

pixel spectrum (peeling off one layer of pixels at a time);

relational functions (the relationship between the views from different viewers);

any of the foregoing extended into three dimensions.

Preferably a transformation is provided for transforming said primary shape parameters onto secondary shape parameters having a fixed range of discrete values.

Preferably the decision as to shape class is made by which decision value is most commonly identified by all the possible different tables.

The shape class decision may also be made by a hierarchical decision process.

It is preferred that said tables are generated by a training procedure in which, for each shape class, a statistically significant sample of objects falling within that class are fed through apparatus for classifying or sorting, further programmed to derive said table. However, it is not necessary to use a training procedure, and tables derived on another apparatus, or even by a computational method, may be used instead. Said groups are preferably pairs, but it is possible to form the table on the basis of groups of three or more primary shape parameters.

BRIEF DESCRIPTION OF THE DRAWINGS

The invention will be further described, by way of example, with reference to the accompanying drawings, in which.

DESCRIPTION OF THE PREFERRED EMBODIMENTS

Figure 1:
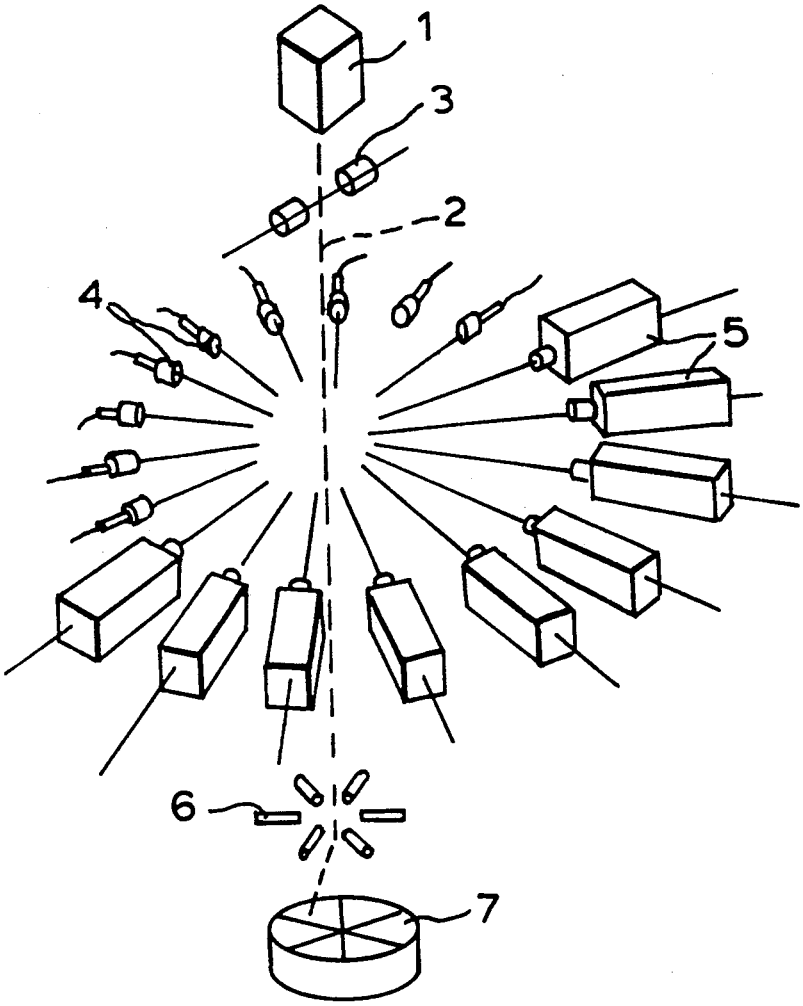
FIG. 1 is a schematic, isometric view of viewing apparatus for use with the invention.

FIG. 1 shows a suitable feeder 1 which feeds the objects one by one vertically downwards in rapid succession. The feeder 1 is just shown schematically as suitable feeders are available. The objects should be fed at least one per second, and preferably more than five per second or ten per second, say twelve per second. The objects are accelerated within the feeder 1, and leave the feeder at a speed of say 1 m/s or preferably 2 m/s. The objects should be unrestrained as they pass through the viewing zone so that the images of the objects are not obscured by any mechanical parts, and thus the objects will be in free flight. Vertical fall is the simplest to arrange, but in theory at least the objects could be projected for instance horizontally through a viewing zone. The path 2 of the objects is indicated. The objects pass through a light curtain 3 which signals their arrival at the shape sorting zone. The light curtain 3 triggers a strobe unit formed by seven illuminators 4. Preferably, the illuminators receive white light from a laser flashlight (flash lamp) by way of fibre optics, and have a lens for forming parallel light. The light can have any suitable wavelength. The length of flash depends upon the speed of the objects, but for a speed of just over 1 m/s, the length can be 15 microseconds.

Diametrically opposite each illuminator 4 there is an electronic viewer 5, the viewers 5 being spaced in one plane around a viewing zone, which plate is at 90° to the direction of feed or path 2 of the objects. In the machine illustrated, there are nine viewers 5, but it may be possible to have as few as four or more suitably five in order to obtain a sensibly efficient sort; sever viewers 5 would be a practical possibility. It will be seen that the viewers are spaced through somewhat under 180°, the angular distance between each viewer 5 being 180° divided by the number of viewers 5. The viewers 5 are each directed at an illuminator 4, so that the image received is of a dark object against a light field—this gives better resolution and a greater depth of focus. No view is needed from above in view of the arrangement of the viewers 5.

After dropping below the plane of the viewers 5 and illuminators 4, the objects pass through a sorting device comprising a ring of a suitable number of air jet nozzles 6 which direct successive objects into one of a number of paths according to their shapes. The nozzles 6 can be connected to compressed air via solenoid valves (not shown). There are shown a number of bins 7 corresponding to the number of nozzles 6, but there could be a central bin as well. The number of nozzles 6 and bins 7 will depend on the types of categories required for the sort. For instance, six bins 7 are required for the decision tree shown in FIG. 3, which is specifically for sorting diamonds having a maximum weight of 4 carat and a minimum weight of 1/15 carat, with less than 30% for hand sorting—the acceptables are sawables and the rejects makeables (the latter may need hand sorting to decide if they should be cleaved). Sawables are diamonds of a shape which can be sawed into two equal or almost equal parts before polishing, whereas makables are of less desirable shape and are unsuitable for sawing (i.e., they are triangular, rounded cubes, too long, flat, generally misshapen, or too badly broken). The intention is to sort the two "low confidence" bins.

Figure 2:
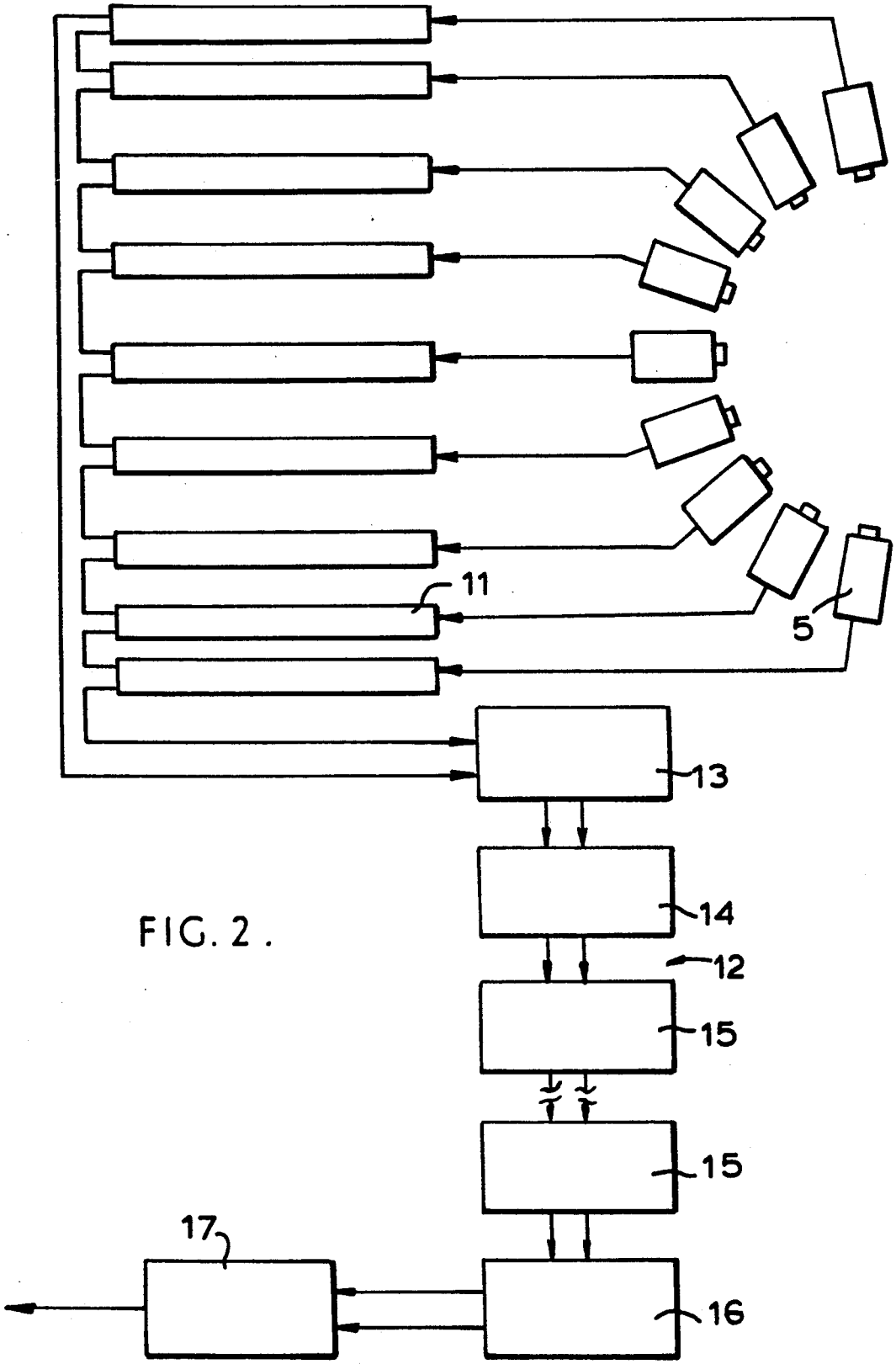
FIG. 2 is a block diagram of the electronics of the apparatus.

As shown in FIG. 2, each viewer 5 is connected to a channel capture board 11 which normalises (white made true white, black made true black) be selecting a voltage threshold between black and white, and digitises the signal, thereby providing digital (video data) single representative of the edges of the object as viewed by the viewer 5, and tracks round the edge or boundary. The data signals are then fed to a computer 12.

Classification of the shape of the object may now be achieved either by a decision tree process according to U.S. Ser. No. 214,465 or by reference to shape decision tables. In each case the data signals from the viewers are fed to a computer 12 where they are analysed to measure three basic shape parameters, which, in the case of the decision tree provide signals for the stages in the decision, and in the case of the method of the invention are processed to give the primary shape parameters.

The decisions tree process will now be described.

The computer 12 incorporates a channel scanner 13 which scans each channel (from each viewer 5) in turn, a general purpose function card 14, a number of special function cards 15, a memory 16 and a head processor 17. The head processor 17 controls the admission of compressed air to the nozzles 6, to open one of the valves. In the arrangement illustrated, separate function cards 14, 15 are used, and these are hard wired. Apart from the general purpose function card 14, each card is specifically for one function. It would be possible to programme these functions using normal software, but the function cards are preferred. The function cards can be changed, for instance if a large amount of a objects having a certain peculiarity must be sorted. The general purpose function card 14 is programmable, so that it can be programmed for any modifications; it runs more slowly than the cards 15 but is more flexible.

Figure 3:
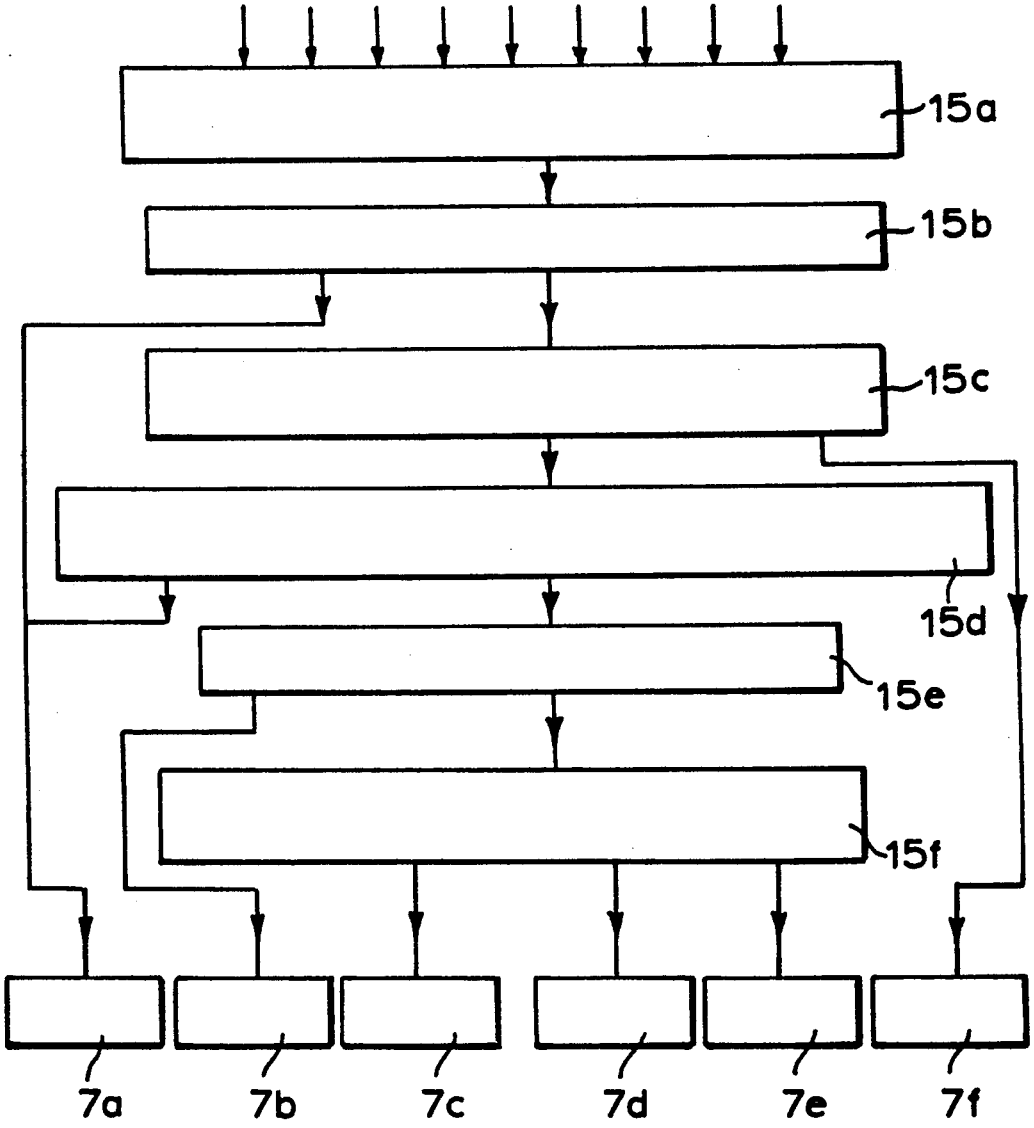
FIG. 3 is a block diagram of the decision tree of the apparatus.

The decision tree is shown in FIG. 3. The general function card 14 is not represented. For each decision, the average value of the basic shape parameter (sphericity, symmetry and convex hull deviance) is determined for all the channels, i.e. views, before combining the basic shape parameters (if required) and making the decision.

Figure 4:
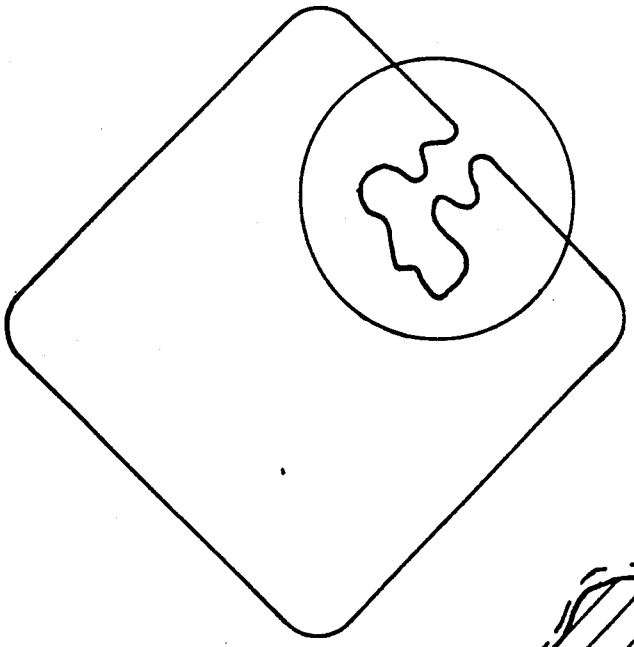
FIG. 4 to 7 represent the functions carried out in the function cards shown in FIG. 2.

At 15*a*, a signal is derived representative of any optical edge breakthrough, and edges are joined on either side of the breakthrough. Edge breakthrough occurs when the objects are translucent or transparent, caused by refraction or internal reflection. There is a highly irregular reentrant, represented schematically in FIG. 4. The edge (boundary) is traced and the rate of change in direction of each incremental length of the edge (boundary) is determined. The rate of change of direction in a normal reentrant is much lower than in a breakthrough. The beginning and end of the zone of large rates of change of direction are determined, and are electronically joined up. If desired, the shortest distance between the beginning and end can be determined —if this is low (say less than 1% of the total edge length as detected), breakthrough is present. Another possibility is to determine the length of the detected edge between the beginning and end of the high frequency profile and compare it to the length of the remainder of the edge—if the high frequency length is greater, breakthrough is present.

Figure 5:
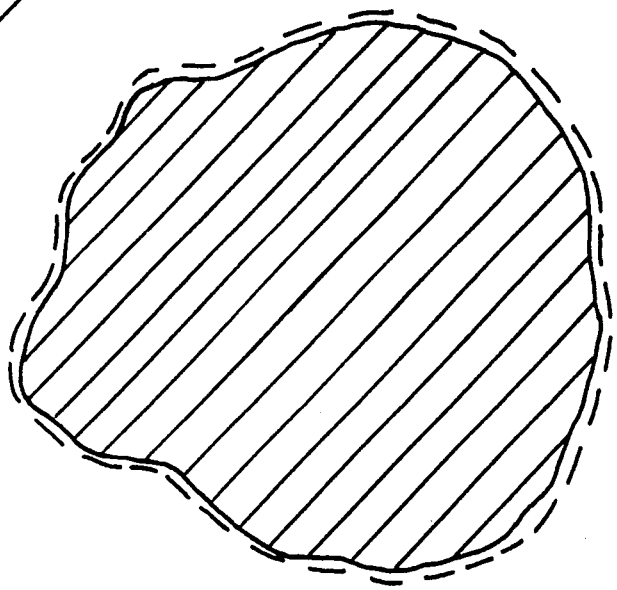
Figure 6:
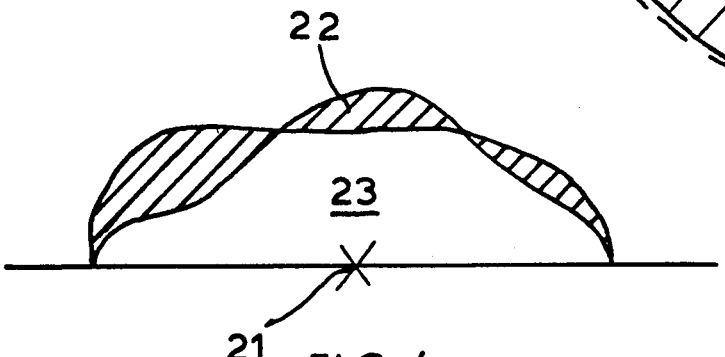

At 15*b*, signals are derived representative of the approximation of the object to a spherical shape (blockiness) and representative of the approximation of the object to symmetry, as illustrated in FIGS. 5 and 6. In order to determine the blockiness, the area of the image is determined and the area is divided by the square of the length of the edge. In order to determine the symmetry, the centroid 21 is determined, the image is divided into two parts along a line passing through the centroid 21, one part is rotated about 180° to superimpose it on the other part, and the mismatch area 22 is compared with the overlapped area 23. The line passing through the centroid 21 may be taken as the horizontal line, thus determining whether there is symmetry about a horizontal plane for that particular channel or view; only one line through the centroid 21 is needed due to the 180° rotation, in order to obtain a good approximation to a determination of axial symmetry about the centroid. The signals representative of blockiness and symmetry are added. Objects having low values are directed to bin 7*a* (high confidence rejects).

Figure 7:
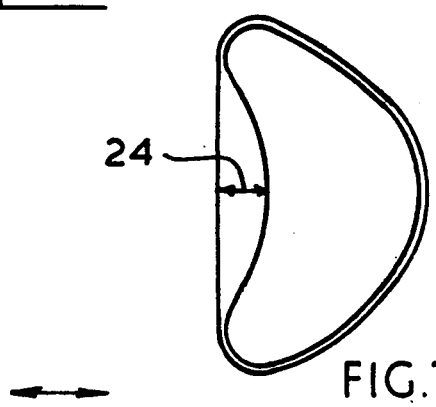

At 15*c*, the sphericity and symmetry are again determined, and also a signal is derived representative of reentrants in the image. The latter signal can be determined by determining the convex hull deviance, i.e. the difference between the length of the edge and the length of the line which extends around the edge but extends, like an elastic band would, straight across any reentrant 24 (see FIG. 7). In more detail, a line of polygonal (say hexagonal) shape is placed around the image and is then shrunk on to the edge of the image by not being permitted to go within the minimum distance between any two points. The signals of blockiness, symmetry and inverse convex hull deviance are combined, and objects having a high value are directed to bin 7*f* (high confidence acceptables).

At 15*d*, the inverse convex hull deviance is combined with the standard deviation of blockiness and symmetry. Objects having a low value are directed to bin 7*a* (high confidence rejects).

At 15*e*, the overall blockiness and symmetry signals are again combined, and low values are directed towards bin 7*b* (medium confidence rejects).

At 15*f*, the signals of overall blockiness, symmetry and inverse convex hull deviance are combined. Low values are directed to bin 7*c* (low confidence rejects), high values are directed to bin 7*e* (medium confidence acceptables) and the remainder are directed to bin 7*d* (low confidence acceptables). It will be appreciated that the limiting values in 15*b* and 15*e* are different, as are the limiting values in 15*c* and 15*f*, thus changing the confidence of the sort.

The method of classification using decision tables will now be described.

The basic shape parameters of blockiness, symmetry and convex hull deviance as derived for the decision tree process are also used.

Preferably, at least four, more preferably nine viewers are used. Thus the apparatus above can produce a set of basic shape parameters of blockiness, symmetry and convex hull deviance for each of the nine viewers. In addition to these twenty-seven parameters, an additional parameter, the total count of edge breakthroughs detected can be derived. Any view with edge breakthrough is marked as invalid, and the signal is suppressed, but the fact of edge breakthrough is recorded, however, if all the views of the object (i.e. the view from each viewer) show edge breakthrough, the object is rejected. A microprocessor derives a smaller set of primary shape parameters, namely the maximum, minimum and mean for all of the viewers for each of the basic shape features, except for convex hull deviance. As the minimum value of convex hull deviance is usually zero, the minimum convex hull deviance signal need not be provided, and a ninth parameter can be provided by the edge-breakthrough count.

In order to classify the objects according to the preferred embodiment of the invention, three sets of fixed information will have to be provided and can be stored in the local memory of the sorting apparatus or machine:

A. A linear transformation, for transforming the values of the primary shape parameters from the sorting machine to normalised shape parameter values.

B. A non-linear mapping of normalised shape parameter values onto secondary shape parameter values. The primary shape parameters may take any value from a continuum and this non-linear mapping maps regions of the continuum onto discrete values of secondary shape parameter. The secondary shape parameters preferably take values 0, 1, 2, . . . up to 15.

C. Decision value map tables (class maps).

It is preferred that the three sets of information A, B and C are derived for each sorting machine by a training procedure.

TRAINING PROCEDURE

The sorting machine can be set up to allow signals from the machine to be fed into a training programme which generates the sets of information A, B and C as set out above.

The information is generated by compiling results for each class of shape. A statistically-viable sample of a given shape class (say 6000 objects from the mid-range of the class and typical of that class) is fed through the machine to provide for each object the nine primary shape parameter signals as set out above. The data is stored on a computerised data storage system with each file of the storage system containing data for the many objects of the same class. The transformation A for normalising the signals from the sorting machine is now generated. This puts the signals into a more suitable form for reading by the following part of the training procedure. For each of the primary shape parameters, the maximum value, $N_{max}$, and the minimum value $N_{min}$ for all the objects of that class are taken and given the values 1023 and 0 respectively. The rest of the values N for each primary shape parameter are transformed linearly into values N' in the range 0 to 1023 by the following relation:

$$N' = \frac{(N - N_{min})}{N_{max} - N_{min}} \times 1023 \qquad \text{A}$$

The relation is the information A referred to above, and is fed into the sorting machine.

Figure 8:
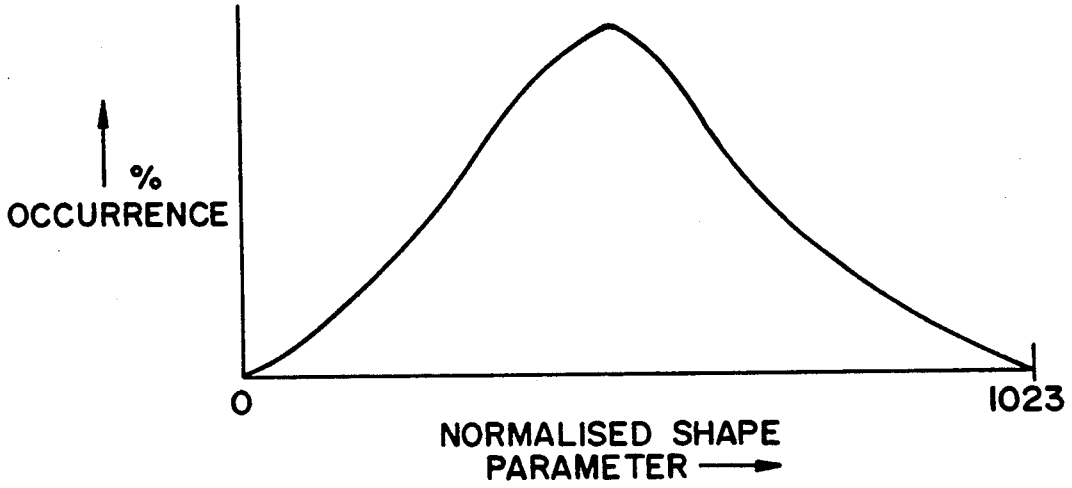
FIG. 8 shows a typical frequency histogram for the linearly transformed values of one of the primary shape parameters in the training process.
Figure 9:
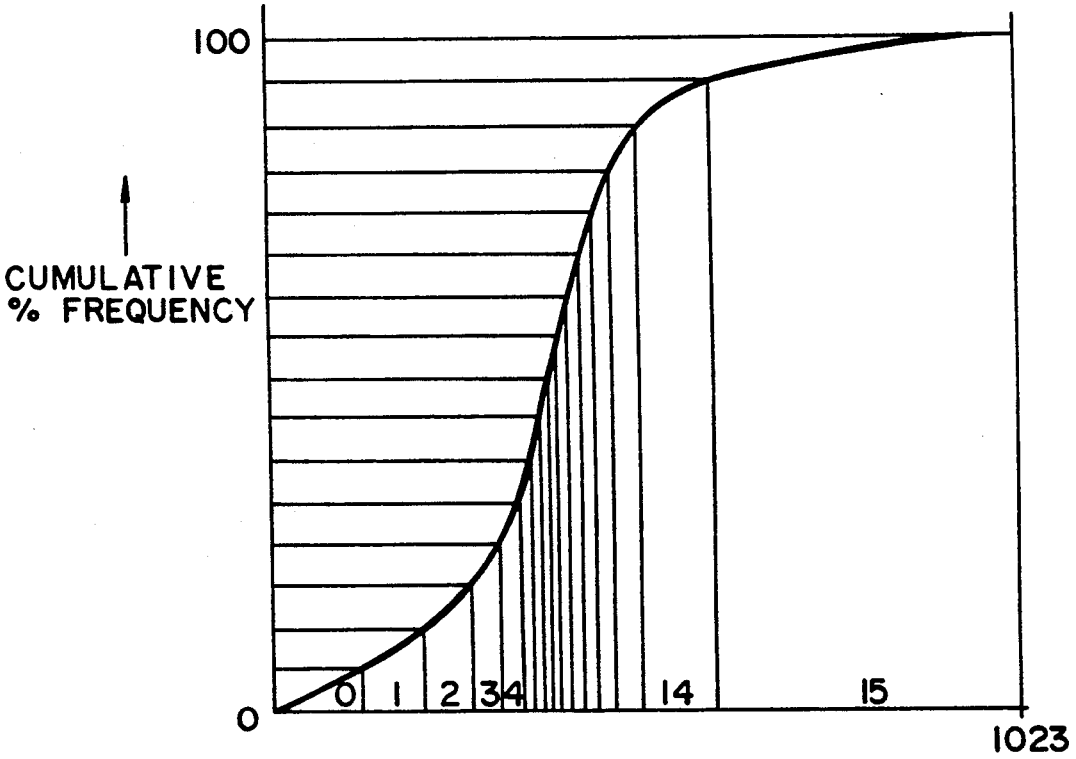
FIG. 9 shows a cumulative frequency histogram for the same values in the training process.

A histogram as shown in FIG. 8 is then generated showing the frequency of occurrence of each value from 0 to 1023. This histogram is then integrated to given a cumulative frequency histogram as shown in FIG. 9. The range of the normalised parameters from 0 to 1023 is then divided into sixteen successive intervals, labelled 0 to 15, each interval having approximately the same number of occurrences—the labels of these intervals are the secondary shape parameters. For a given information loss, the secondary shape parameters can be quanticized more coarsely than the primary shape parameters.

The non-linear transformation of the normalised parameter values lying in the range 0 to 1023, to the secondary shape parameters is the information B referred to above, and is fed into the sorting machine. This process is repeated for as many classes of shape as are required for the classification or sorting being undertaken. For instance, in sorting rough diamonds, one can sort into nine classes of sawables and seven classes of makeables (sixteen classes in all), namely:

Sawables:
- octahedral perfect crystals
- octahedral imperfect crystals
- octahedral stones (i.e. not pure single crystals)
- long perfect crystals
- long imperfect crystals
- long stones
- irregular stones
- shaped stones
- cubes—irregular and concave (i.e. waisted)

Makeables:
- maccles (triangular)
- chips (broken)
- longs (long chips)
- flats
- near sawables (between sawables and makeables)
- cubes—rounded
- cubes—geometrically perfect There can also be three classes of rejects, namely:

- misfeeds;
- no vote (where the stone is of a type unrecognised by the machine);
- undecided (where the stone is borderline between classes).

Data for all the classes is now compiled by drawing up shape classification occurrence maps. These may be in the form of tables as in FIG. 10 in which the rows represent the values from 0 to 15 of one of the nine secondary shape parameters (for example mean value of symmetry) and the columns represent values from 0 to 15 of a second, different secondary parameter (for example mean values of blockiness). Tables of this form are generated for all of the possible different groups or combinations of two secondary shape parameters. In this case there will be 9 C2 combinations, that is 9!/2!, 7! = 36 tables. This is for the case where n, the number of secondary shape parameters in a group or combination, is 2. It will be appreciated that each table corresponds not only to a combination of secondary shape parameters, but also corresponds to the primary shape parameters from which the secondary shape parameters are derived. Tables are completed by entering into each square the frequency with which the two different secondary shape parameters occurred together out of the total 6,000 objects, listed for each class. The sum of frequencies for each class across a row or down a column should be 6,000 divided by 16 i.e. 375, because of the way the secondary shape parameters are derived from the primary shape parameters. There is a reading in each square of the table for each of the classes tested.

Figure 10:
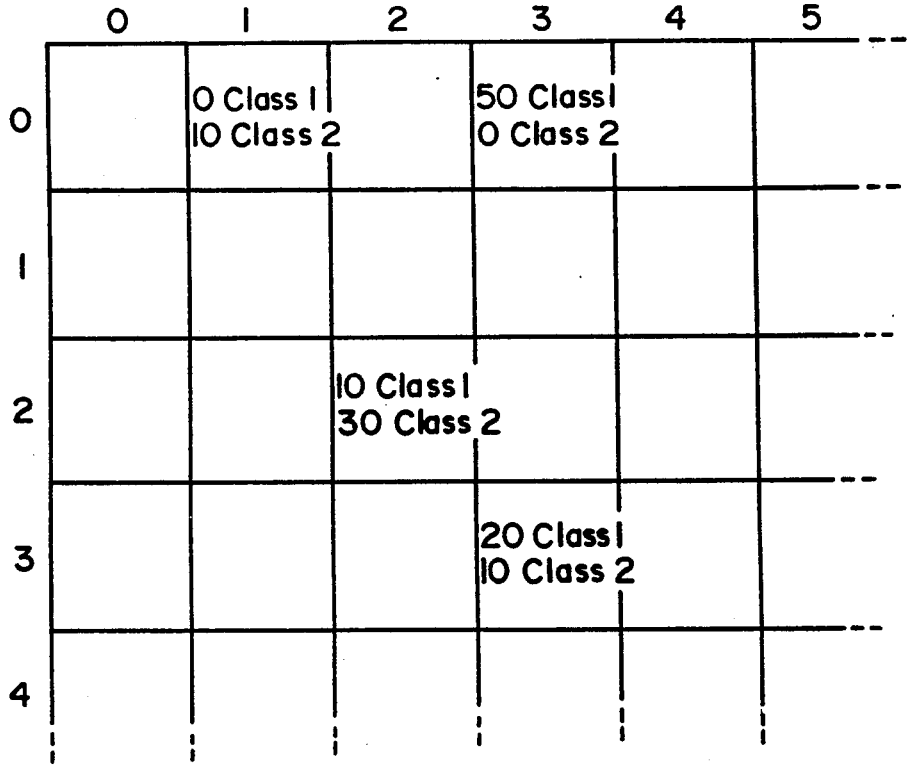
FIG. 10 shows an occurrence map table from the training process.
Figure 11:
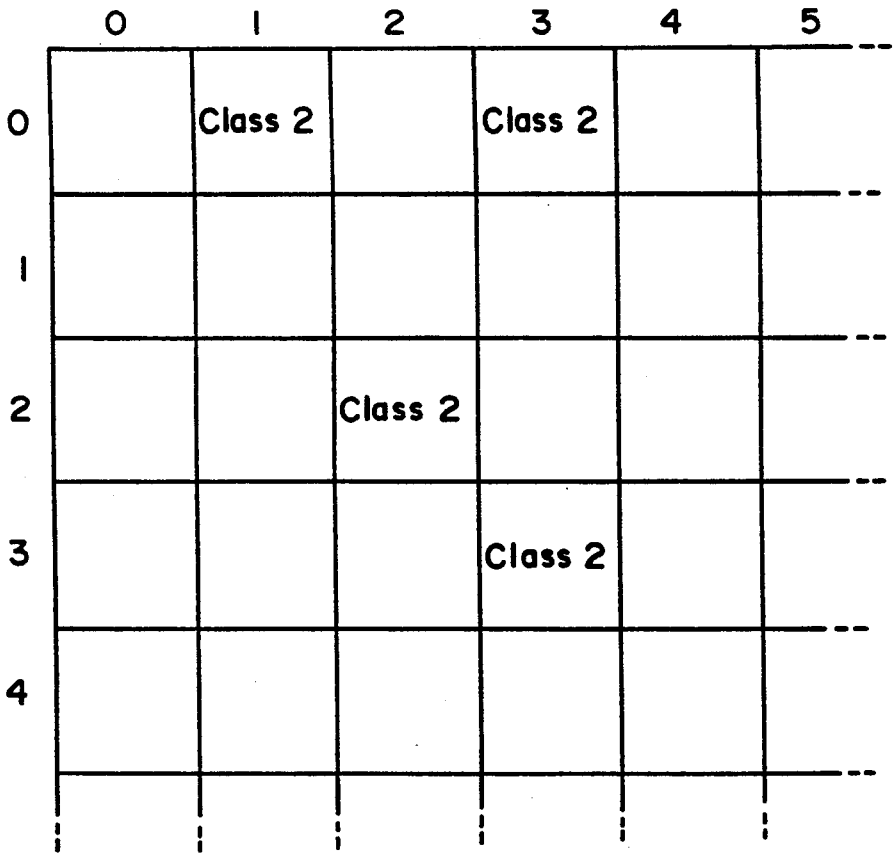
FIG. 11 shows a table for a pair of secondary shape parameters (showing shape identifications for only some of the pairs of parameter values)

Shape classification map tables (class maps) as in FIG. 11 are then generated from the occurrence map tables of FIG. 10 by deriving a shape identification for each square of the table. The occurrence space, defined by the occurrence map tables, is mapped onto shape classification space by using the k-Nearest Neighbour (or alternative Parzen Window etc.) technique. Class decisions for each block of the tables are based on:

$$\text{If}\left(\frac{\text{Class 1}}{\text{Class 2}} > Y_{F1}\right)\text{then Class 1}$$

$$\text{If}\left(\frac{\text{Class 2}}{\text{Class 1}} > Y_{F2}\right)\text{then Class 2}$$

where $Y_{F1}$ and $Y_{F2}$ are yield factors based on the purity of the sort required, i.e. the target error rates. The training procedure can be re-run with different target error rates, possibly several times, until a suitable sort is achieved. The shape classification space maps are stored in a computerised memory and are the information C referred to above; they are fed into the sorting machine.

SORTING

Once the machine has been trained as above or supplied with the necessary information from another source, it can be used to ascertain the shape class of an object, using the physical sorting apparatus disclosed in GB-A-2184832, in which compressed air nozzles are provided to direct an object whose shape has been determined and which is leaving the shape measuring zone to an appropriate shape bin, a rapid succession of objects being processed. A microprocessor operating according to the invention activates the compressed air supply of the nozzles by a solenoid in order to direct the object into the bin corresponding to its shape class.

Figure 12:
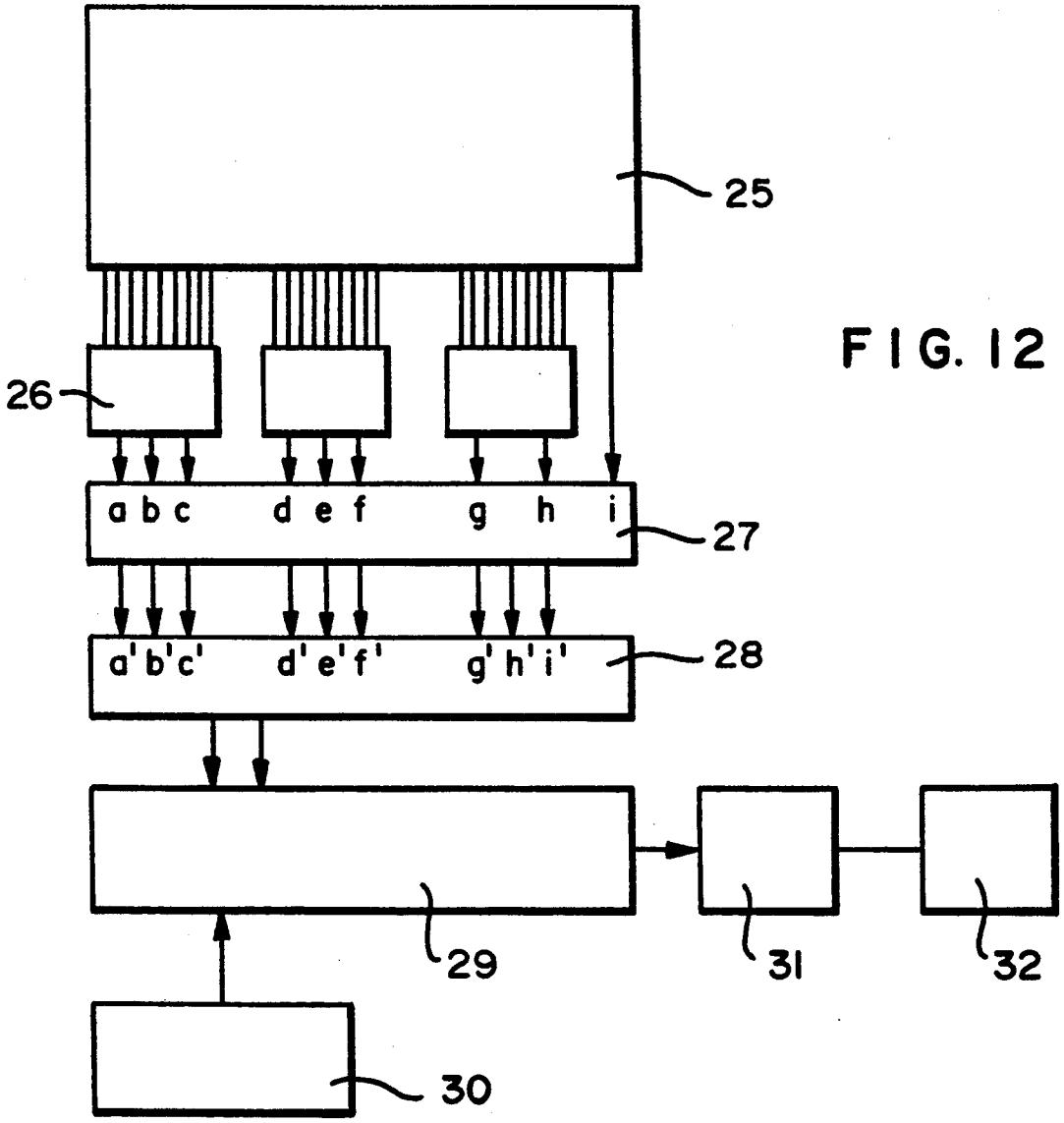
FIG. 12 shows a flow chart for the shape classification process.

FIG. 12 shows a flow chart for the shape classification process.

In operation, the object is fed through the detecting zone, and at 25 the signals from the viewers are processed to given 27 primary shape parameter readings, plus a reading representing the total number of edge-breakthroughs, which readings are in turn processed at 26 as set out above to give nine primary shape parameters a to i. These primary shape parameters a to i are then transformed at 27 by transformation A followed by transformation B to give secondary shape parameters a' to i' having values between 0 and 15. Secondary shape parameters are then taken in paris at 28 and a shape decision value is read off from the appropriate shape classification map table at 29. Means 30 for holding all the possible shape classification map tables, are provided in the form of a RAM or computerised memory. This shape decision value will just be a class identification, and it is stored in a memory at 31. The process is the repeated for all the remaining possible different combinations of two different secondary shape parameters. Using nine primary shape parameters, a total of 36 shape decision values are produced for each object. The final shape decision, which ascertains the shape class of the object, is made at 32 and is based upon a majority vote system:

$$\text{If}\left(\frac{\text{Class 1}}{\text{Class 2}} > Ed_1\right)\text{then Class 1}$$

$$\text{If}\left(\frac{\text{Class 2}}{\text{Class 1}} > Ed_2\right)\text{then Class 2}$$

where: $Ed_1$ an $dEd_2$ are experimentally derived factors to produce the required sort characteristics. With this system there will be some 'undecided' or 'no vote' results, and one or two bins will be provided for them. These are then hand-sorted.

Figure 13:
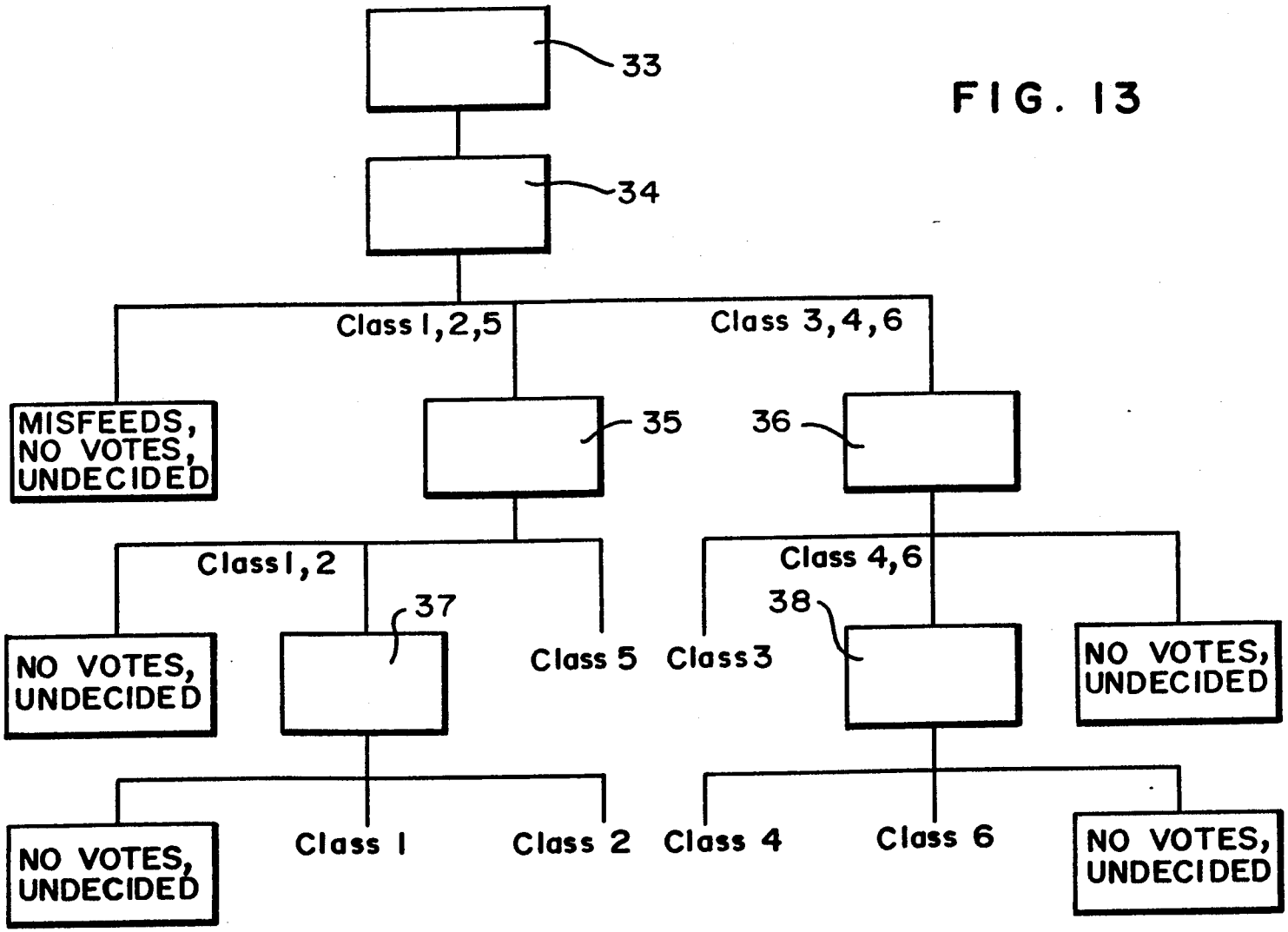
FIG. 13 shows a decision tree for the shape class decision process.

If the objects are to be sorted into more than two non-reject shape classes, a decision tree, as shown in FIG. 6, may be used. The secondary shape parameters are fed into a sequence of classifiers, each classifier being set up to classify the object into one of two shape class groups or into a misfeed/no vote/undecided class. FIG. 13 shows an example of a decision tree for six shape classes.

Secondary shape parameters are collected at 33 and passed to the first classifier 34. This decides whether the object belongs to a group of classes 1, 2 and 5 or to the group of classes 3, 4 and 6, or is misfed, no-vote or undecided.

If the object belongs to one of the groups of classes the information is then fed to classifier 35 or 36, according to which group of classes the object belongs to. Classifier 35 has three outputs: objects belonging to class 1 or class 2, object belonging to class 5 and undecided. Similarly, classifier 36 has the outputs: objects belonging to class 3, objects belonging to class 4 or 6 and undecided.

If the object is found to belong to class 1 or 2, or to class 4 or 6, the information is passed to classifier 37 or 38 which classify the object as undecided, class 1 or class 2in the case of classifier 37, and class 4, class 6 or undecided in the case of classifier 38.

For a stone to be assigned to class 4, the information must be passed from classifier 34 to classifier 26, and thence to classifier 38, the outputs being, in order; "class 3, 4, 6", "class 4 or 6", "class 4".

Each individual classifier has its own target error rate values ($Y_F$ and $E_d$).

The foregoing description is applicable to any sorting machine with three or more viewers. With two viewers, the mean values of the primary shape parameters are not derived. With one viewer, a single primary shape parameter is produced for each of say blockiness, symmetry and convex hull deviance.

The present invention has been described above purely by way of example, and modifications can be made within the spirit of the invention.

We claim:

1. A method of ascertaining the shape class of an object, comprising:

deriving a set of primary shape parameters representative of the shape of the object, taking a combination of n of the primary shape parameters to provide coordinates for deriving from a previously established table a decision value for said combination, n being a fixed integer which is two or more, the table having decision values corresponding to said combination;

repeating the process of deriving a decision value for all remaining possible different combinations of n primary shape parameters, using previously established tables having decision values, each table corresponding to a combination of n primary shape parameters; and ascertaining from the resulting set of decision values the shape class of the object.

2. The method of claim 1, further comprising the steps of:

feeding the object through a viewing zone;

illuminating the object as it passes through the viewing zone, using at least one viewer viewing substantially the whole of the profile of the object as presented to the viewer;

deriving from the viewer signals representative of substantially the whole of the profile of the object as viewed at a particular instant by the viewer;

processing the signals to provide the set of primary shape parameters.

3. The method of claim 2, wherein a plurality of viewers spaced in one plane around the viewing zone is used, and the primary shape parameters are derived by taking the maximum, mean and minimum values of each of at least two basic shape parameters representative of the edges of the object.

4. The method of claim 1, wherein the primary shape parameters are transformed by a mapping including a linear transformation onto a set of normalised shape parameters having values lying in a fixed range.

5. The method of claim 1, wherein the primary shape parameters are transformed onto secondary shape parameter taking values from a fixed set of values, by a transformation including a non-linear mapping.

6. The method of claim 1, wherein the primary shape parameters are taken in pairs for deriving said decision value, wherein a table having rows and columns is provided for each pair of primary shape parameters;

the rows of the table representing all the possible values derived from one of the primary shape parameters and the columns of the table representing all the possible values derived from the other primary shape parameter, and the spaces in the table containing a shape identification;

wherein the values of the primary shape parameters derived for the object are used to read a shape identification from the table.

7. The method of claim 1, wherein, the shape class of the object is ascertained by a majority vote system based on the number of times each decision value is derived from all the tables.

8. The method of claim 1, wherein the method is used to sort the object into one of two classes, or to reject the object.

9. The method of claim 1 in which each decision value in each table comprises a vote for the object belonging to a first class, or to a second class, or no vote for the object belonging to either class.

10. The method of claim 1, wherein deriving the primary shape members includes the step of deriving a basic shape parameter representative of any optical edge breakthrough at the profile of the object and joining up edges on either side of the breakthrough.

11. The method of claim 1, wherein deriving the primary shape parameters includes the step of deriving a basic shape parameter representative of the approximation of the object to a spherical shape.

12. The method of claim 1, wherein deriving the primary shape parameters includes the step of deriving a basic shape parameter representative of the approximation of the object to symmetry.

13. The method of claim 1, wherein deriving the primary shape parameters includes the step of deriving a basic shape parameter representative of re-entrants in the image.

14. The method of claim 3, wherein a primary shape parameter is derived representative of the total number of edge breakthroughs observed for all the viewers.

15. The method of claim 1 wherein n is less than the number of primary shape parameters.

16. A method of ascertaining the shape class of an object, comprising:

feeding the object through a viewing zone;

illuminating the object as it passes through the viewing zone, using at lest one viewer viewing substantially the whole of the profile of the object as presented to the viewer;

deriving from the viewer signals representative of substantially the whole of the profile of the object as viewed at a particular instant by the viewer;

processing the edge signals to produce a set of basic shape parameters, the set of basic shape parameters including a parameter representative of the approximation of the object to a sphere, a parameter representative of the approximation of the object to symmetry, a parameter representative of the convex hull deviance of the object and a signal representative of the number of edge breakthroughs for the view;

deriving a set of primary shape parameters by taking the maximum, average and minimum for all the views of each of the said basic shape parameters of approximation to a sphere and to symmetry, the maximum and average values of convex hull deviance and the total count of edge breakthroughs for all the views;

transforming the primary shape parameters onto normalised shape parameters having values lying in a fixed range;

transforming the normalised shape parameters onto a set of secondary shape parameters, taking values from a fixed set of values;

taking a pair of the secondary shape parameters as co-ordinates for deriving from a table a decision value for said pair, the table being fixed for all the objects for said pair the rows of said table representing all the possible values of one of said pair of secondary shape parameters, the columns of the table representing all the possible values of the other of said pair of secondary shape parameters, and the spaces in the table representing a shape identification in the form of a vote for one of two shape classes, or no vote for either;

repeating the process of deriving a decision value for all the remaining possible different pairs of secondary shape parameters using a specific said table for each pair; and ascertaining from the resulting set of shape identification the shape class of the object on the basis of a majority vote system.

17. A classifying machine for classifying a succession of objects according to shape, comprising:

a viewing zone through which each successive object will be fed;

means for illuminating the object as it passes through the viewing zone;

at lest one electronic viewer for generating viewer signals upon viewing the object as it passes through the viewing zone;

means for deriving, from the viewer signals, edge signals representative of the edge of the object as viewed by the viewer;

means for deriving from the edge signals a set of primary shape parameters representative of the shape of the object;

means for holding decision value tables for all groups of n of the primary shape parameters when such groups are used to provide coordinates to the respective tables, n being a fixed integer which is two or more;

means for providing said coordinates to respective said tables and deriving from respective said tables decision values for the respective groups; and means for ascertaining from the resulting set of decision values the shape class of the object.

18. The classifying machine of claim 17, wherein a plurality of viewers spaced around the viewing zone is used;

the edge signals being processed to produce a set of basic shape parameters, the set of basic shape parameters including a parameter representative of the approximation of the object to a sphere, a parameter representative of the approximation of the object to symmetry, a parameter representative of the convex hull deviance of the object and a signal representative of the number of edge breakthroughs for that view;

the primary shape parameters being the maximum, average and minimum for all the views of said basic shape parameters of approximation to a sphere and symmetry, the maximum and average values of convex hull deviance and the total count of edge breakthroughs for all the views;

the primary shape parameters being transformed onto normalised shape parameters having values lying in a fixed range for the machine;

the normalised shape parameters being mapped onto a set of secondary shape parameter, taking values from a set of values defined for the machine;

said means for providing coordinates to said tables providing said secondary shape parameters in pairs;

tables for all possible different pairs of secondary shape parameter being stored in a memory, the rows of said tables representing all the possible values of one of said pair of secondary shape parameters, the columns of the table representing all the possible values of the other of said pair of secondary shape parameters, and the spaces in the table representing a shape identification, in the form of a vote for one of two shape classes, or no vote for either;

the means for deriving decision values from said tables for the respective pairs having means to read a shape classification vote from said table using the secondary shape parameters as coordinates;

the means for ascertaining the shape class of the object comprising a memory in which all the shape class votes provided by said means for deriving decision values are stored and means for classifying the object as belonging to the first class, belonging to the second class or undecided on a majority vote basis using said shape class votes.

* * * * *